US007699294B2

(12) United States Patent
Pattullo

(10) Patent No.: US 7,699,294 B2
(45) Date of Patent: Apr. 20, 2010

(54) CHARGE FORMING DEVICE WITH IDLE AND OPEN THROTTLE CHOKE CONTROL

(75) Inventor: George M Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 328 days.

(21) Appl. No.: 11/738,234

(22) Filed: Apr. 20, 2007

(65) Prior Publication Data

US 2008/0258320 A1 Oct. 23, 2008

(51) Int. Cl.
*F02M 1/02* (2006.01)

(52) U.S. Cl. ..... 261/52

(58) Field of Classification Search ..... 261/52
See application file for complete search history.

(56) References Cited

U.S. PATENT DOCUMENTS

| | | | | | |
|---|---|---|---|---|---|
| 2,901,229 | A * | 8/1959 | Sarto | 261/39.3 |
| 3,575,385 | A * | 4/1971 | Szwargulski et al. | 261/23.2 |
| 4,123,480 | A * | 10/1978 | Johansson | 261/52 |
| 4,169,872 | A * | 10/1979 | Latz et al. | 261/52 |
| 4,773,362 | A * | 9/1988 | Wissmann et al. | 123/179.16 |
| 4,961,409 | A * | 10/1990 | Kobayashi et al. | 123/376 |
| 4,983,330 | A * | 1/1991 | Harbeke | 261/52 |
| 5,200,118 | A * | 4/1993 | Hermle | 261/64.6 |
| 5,215,049 | A * | 6/1993 | Wolf | 123/179.18 |
| 5,262,092 | A * | 11/1993 | Reeder et al. | 261/35 |
| 5,500,159 | A * | 3/1996 | Martinsson | 261/52 |
| 6,202,989 | B1 * | 3/2001 | Pattullo | 261/52 |
| 6,439,547 | B1 * | 8/2002 | King et al. | 261/52 |
| 6,454,245 | B2 * | 9/2002 | Kobayashi | 261/52 |
| 6,494,439 | B1 | 12/2002 | Collins | |
| 6,848,405 | B1 * | 2/2005 | Dow et al. | 123/179.18 |
| 7,144,000 | B2 * | 12/2006 | Roth et al. | 261/39.3 |
| 7,275,508 | B2 * | 10/2007 | Pattullo | 123/179.18 |
| 7,334,551 | B2 * | 2/2008 | Pattullo | 123/179.18 |
| 2001/0013664 | A1 * | 8/2001 | Kobayashi | 261/52 |
| 2003/0075132 | A1 * | 4/2003 | Ohsawa et al. | 123/179.18 |
| 2006/0070594 | A1 * | 4/2006 | Pattullo | 123/179.18 |

FOREIGN PATENT DOCUMENTS

| | | | | |
|---|---|---|---|---|
| JP | 61-61954 A * | 3/1986 | | 261/52 |

* cited by examiner

*Primary Examiner*—Richard L Chiesa
(74) *Attorney, Agent, or Firm*—Reising Ethington P.C.

(57) ABSTRACT

A charge forming device may include a body having a fuel and air mixing passage, a throttle valve and choke valve moveable between first and second positions to control at least in part the fluid flow in the fuel and air mixing passage, and throttle and choke control members associated with the throttle and choke valves, respectively. The choke control member may also be associated with an engine starting system so that the choke valve is moved to its second position upon actuation of the starting system. The choke control member is selectively associated with the throttle control member to hold the choke control member in a position spaced from its first position. In this manner, the throttle valve and choke valve may be automatically positioned in a desired position for starting of the engine upon actuation of the engine starting system.

24 Claims, 5 Drawing Sheets

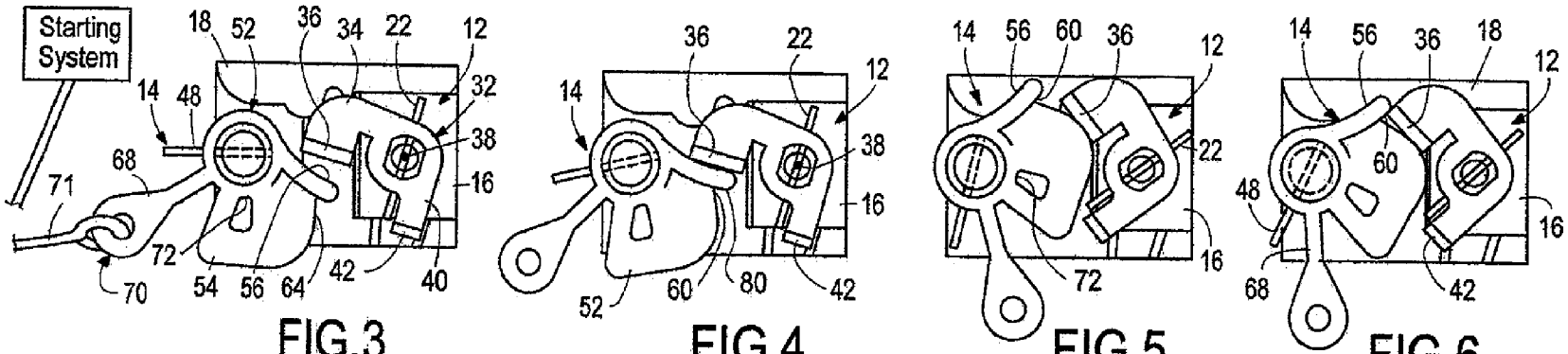
FIG.3
FIG.4
FIG.5
FIG.6
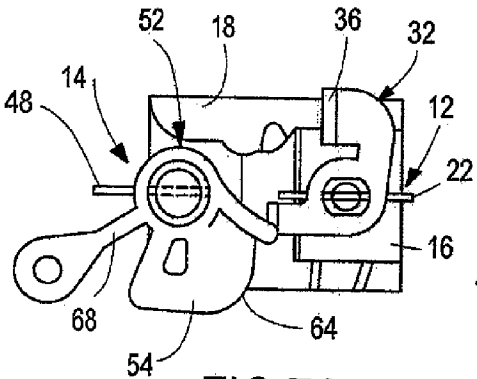
FIG.7A
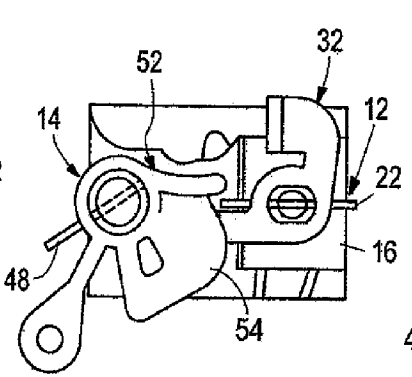
FIG.8A
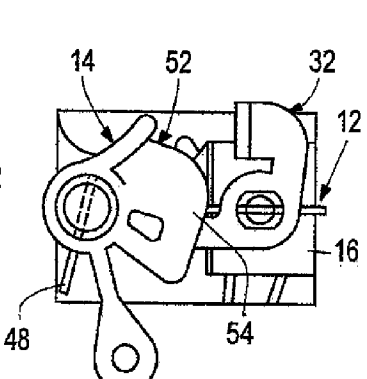
FIG.9A
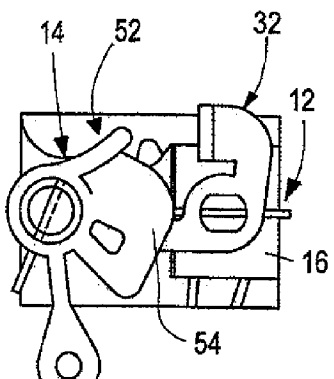
FIG.10A

CHARGE FORMING DEVICE WITH IDLE AND OPEN THROTTLE CHOKE CONTROL

FIELD OF THE INVENTION

This invention relates generally to a charge forming device for an engine, and more particularly to a charge forming device with a choke valve.

BACKGROUND OF THE INVENTION

Charge forming devices such as carburetors are known to include a choke valve to facilitate starting a cold engine. The choke valve may be manually closed before attempts to start the engine, or the choke valve may be automatically momentarily closed during an attempt to start an engine, such as by pulling a starter cord. In some starting systems, the choke valve is actuated when a starter cord is pulled to start the engine whereupon the choke valve is closed during a portion of the starter cord stroke when there is greatest resistance on the cord, such as when a piston of the engine approaches and reaches top dead center. After the higher resistance portion of the starter cord stroke, the choke valve returns toward its open position under force of a return spring. Accordingly, the engine may initially start while the choke valve is momentarily closed, and then die out as the choke valve moves away from its closed position.

SUMMARY OF THE INVENTION

According to one presently preferred implementation, a charge forming device for an engine having a starting system, includes a body having a fuel and air mixing passage, a throttle valve, a choke valve and throttle and choke control members. The throttle valve and choke valve may be moveable between first and second positions to control at least in part the fluid flow in the fuel and air mixing passage. The throttle control member is associated with the throttle valve, and the choke control member is associated with the choke valve, and with the starting system of the engine so that the choke valve is moved to its second position upon actuation of the starting system. The choke control member is selectively associated with the throttle control member to hold the choke control member in a position spaced from its first position. In this manner, the throttle valve and choke valve may be automatically positioned in a desired position for starting of the engine upon actuation of the engine starting system.

According to another implementation, a carburetor includes a body having a fuel and air mixing passage, a throttle valve and a choke valve. The throttle valve and choke valve may be moveable between first and second positions to control at least in part the fluid flow in the fuel and air mixing passage. A first throttle control member and a second throttle control member may both be associated with the throttle valve. A first choke control member and a second choke control member may both be associated with the choke valve, the first choke control member is engageable with the first throttle control member when the throttle valve is in its first position and the choke valve is in its second position, and the second choke control member is engageable with the second throttle control member when the throttle valve is in its second position and the choke valve is in its second position. In one implementation, this permits the throttle and/or choke valves to be maintained in preferred starting positions at different positions of the throttle valve. Representative positions of the throttle valve prior to actuation of an engine starting system may include idle, a start position off-idle, and wide open throttle.

In at least one implementation, when the choke valve is actuated upon actuation of the starting system, the position of throttle and choke valves can be set without direct operator interaction with these valves. This arrangement can greatly facilitate starting the engine, improve the reliability of starting the engine, reduce operator error and complaints, facilitate returning the valves to desired positions after the engine is started, and may be embodied in a relatively simple design that is economical to manufacture and assemble. Further, a desired position of the throttle and choke valves can be maintained by interference or engagement of control members associated with these valves. The throttle and choke valve control members can be single, unitary parts carried by their respective valves, or they may comprise more than one part. Of course, many other features and advantages will be readily apparent to persons of ordinary skill in this art. And a charge forming device may achieve or contain more, fewer or different objects features and advantages.

BRIEF DESCRIPTION OF THE DRAWINGS

The following detailed description of exemplary embodiments of the invention will best be understood with reference to the accompanying drawings, in which:

FIGS. 3-6 are side views of the charge forming device illustrating a choke control member and a throttle control member as they are moved between an initial open position of the choke valve and an idle position of the throttle valve, to start positions of both the choke valve and throttle valve;

FIGS. 7A-10A are side views of the charge forming device illustrating the choke control member and throttle control member moving between an open position of the choke valve and a wide open position of the throttle valve to a closed position of the choke valve and a wide open position of the throttle valve to facilitate starting an engine at wide open throttle;

FIGS. 7B-10B are perspective views of a choke valve and a throttle valve of the charge forming device illustrating the choke control member in throttle control member in the same positions as the corresponding views 7A-10A;

DETAILED DESCRIPTION OF PREFERRED EMBODIMENTS

Figure 2:
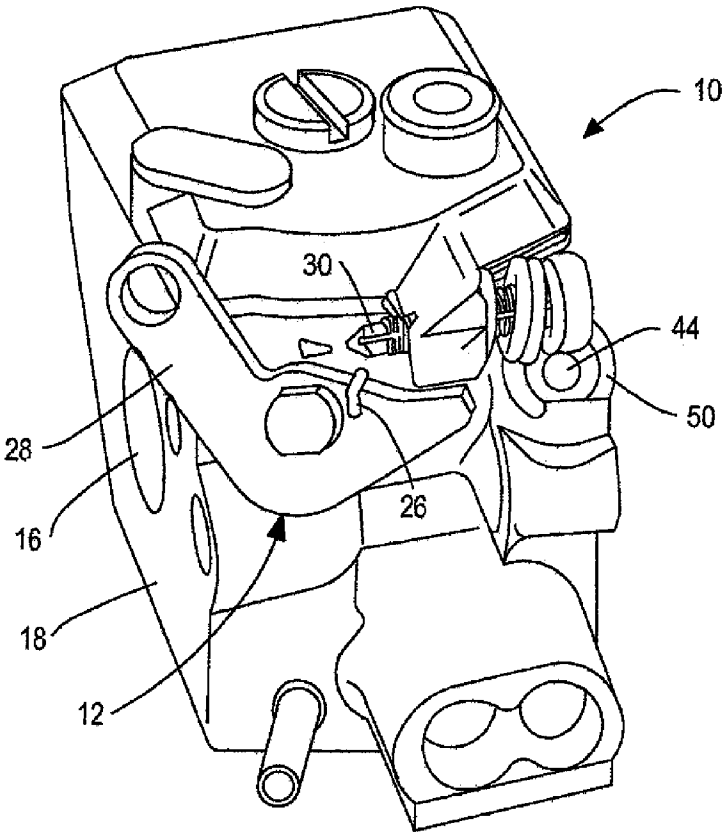
FIG. 2 is a perspective side view of the charge forming device of FIG. 1 with the throttle valve shown in its wide open position.
Figure 1:
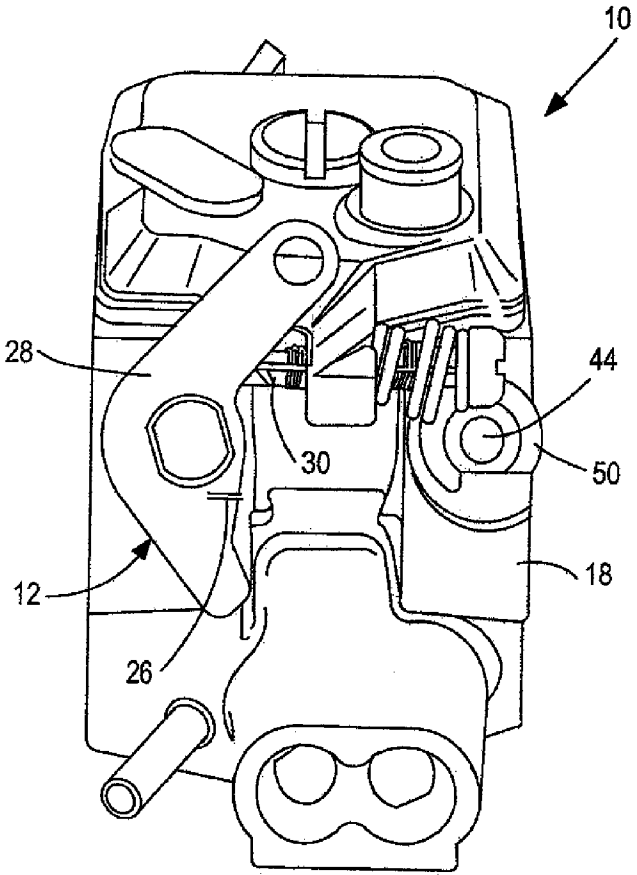
FIG. 1 is a perspective side view of one embodiment of a charge forming device with a throttle valve shown in its idle position.

Referring in more detail to the drawings, FIGS. 1 and 2 illustrate a charge forming device 10 or carburetor that provides a fuel and air mixture to an internal combustion engine to support combustion and operation of the engine. The carburetor 10 includes a throttle valve 12 and a choke valve 14 both of which are adapted to control air flow through a fuel and air mixing passage 16 in at least certain operating conditions, as is known. For example, upon starting a cold engine the choke valve 14 may be closed, and the throttle valve 12 may be in its idle position, an off idle start position, or a wide open position. The choke valve 14 may be manually rotated to its closed position, or in some systems, the choke valve 14 may automatically be rotated to its closed position upon attempted starting of the engine, such as by pulling a starter cord of a starting system. In such a system, the starter cord may be directly or indirectly linked to the choke valve 14 to move the choke valve 14 to its closed position automatically as the starter cord is pulled.

In more detail, the carburetor includes a main body 18 in which the fuel and air mixing passage 16 may be formed. The carburetor 10 may also include diaphragm type fuel pump and fuel metering assemblies as is known in the art. The fuel metering chamber may be communicated with and provide a supply of fuel for delivery to the fuel and air mixing passage 16 as also is known in the art. The general construction of the carburetor 10, including the fuel pump and fuel metering systems, may be substantially as disclosed in U.S. Pat. No. 5,262,092 (although the diaphragm need not be constructed as taught in that patent) the disclosure of which is incorporated herein by reference in its entirety. Accordingly, these details of the carburetor 10 will not be further described.

Figure 7B:
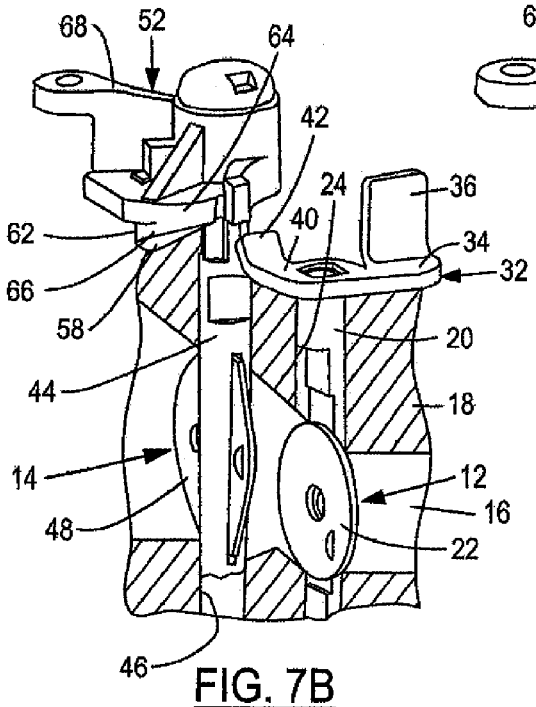
Figure 8B:
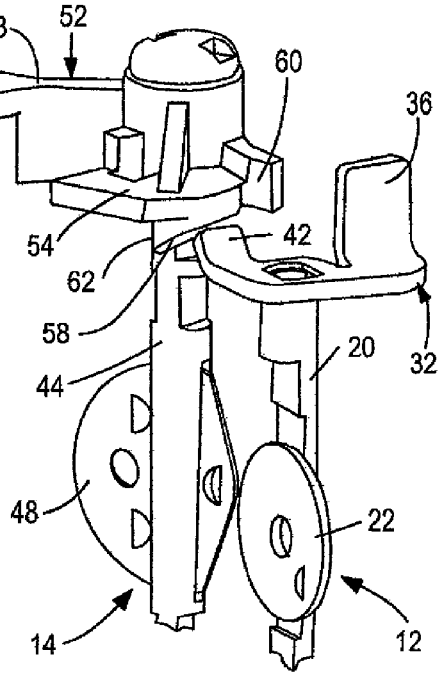

As best shown in FIGS. 7B, 8B, 9B and 10B, the throttle valve 12 may be a butterfly type valve having a valve shaft 20 and a valve head 22 carried by the valve shaft 20 for co-rotation therewith. The valve head 22 may include a generally flat disc and may be of a size that is suitable for pivoted or rotational movement within or adjacent to the fuel and air mixing passage 16. As shown in FIG. 7B, the throttle valve shaft 20 may extend through a bore 24 that intersects the fuel and air mixing passage 16 and out of diametrically opposed sides or faces of the carburetor. A return spring 26 biases the throttle valve 12 toward its idle position and may act on the carburetor body 18 and an idle control lever or member 28 carried on one end of the shaft 20. The idle control member 28 may engage a stop, such as a screw 30, the position of which may be adjustable to permit adjustment of the angular orientation of the throttle valve 12 in its idle position. The idle control member 28 may be connected to a throttle cable (not shown) in a known manner to effect rotation of the throttle valve 12 as commanded by an operator of the engine. As best shown in FIGS. 3-10, a throttle control member 32 may be carried by the throttle valve shaft 20 adjacent its opposite end. The throttle control member 32 may include a generally radially extending arm 34, and an axially extending finger 36 carried by the arm 34 spaced from the axis of rotation 38 of the shaft 20. A second arm 40 may extend away from the axis 38 of the shaft 20 and may terminate in an upwardly extending tab 42 laterally spaced from the finger 36 of the arm 34.

As best shown in FIGS. 7B, 8B, 9B and 10B, the choke valve 14 may be constructed in similar manner as the throttle valve 12, with a valve shaft 44 extending through a bore 46 that intersects the fuel and air mixing passage 16 and a valve head 48 carried for rotation by the shaft 44. The valve head 48 may also be a relatively thin and flat disc rotatably carried in or adjacent to at least a portion of the fuel and air mixing passage 16. In its closed or choke engaged position, a gap may be provided between the valve head 48 and the fuel and air mixing passage 16 to permit a controlled but limited air flow therethrough. Of course, other arrangements, such as holes or slots in the valve head 48 can be provided to enable the desired choke air flow. Still other mechanisms, passages or the like can be provided to enable a choke air flow even if the choke valve is fully closed and no air flow provision is made at or in the choke valve 14 itself.

At one end, the choke valve shaft 44 may be retained on the carburetor body 18 by a suitable clip or other retainer 50. At its other end, a choke control member 52 may be provided as best shown in FIGS. 3-10. The choke control member 52 may include a generally radially extending flange 54 having a first cam surface 56, a second cam surface 58, a first throttle valve retainer or catch 60 and a second throttle valve retainer or catch 62. The first catch 60 may be defined between the first cam 56 and a peripheral surface 64 of the choke control member 52. The second catch 62 may be defined by an axially extending face or projection 66 of the second cam 58. The choke control member 52 may also include an arm 68 extending generally radially therefrom and including an attachment feature 70 adapted to receive a cable, link or other feature 71 that connects to the choke control member 52 and controls rotation of the choke valve 14 between its open and closed positions. A return spring 72 (shown in FIG. 9B) may be provided to yieldly bias the choke valve 14 toward its open position. In the embodiment shown, a torsion spring is used with one end of the spring engaging the carburetor body 18 and another end of the spring acting on the choke control member 52.

In use, prior to starting a cold engine, the throttle valve 12 may be in its idle position under the force of its return spring 26, and the choke valve 14 may be in its open position, under the force of its return spring 72. In one implementation, the choke control member 52 is linked, either directly or indirectly, to a starter cord that is pulled by a user to crank the engine in known manner. Such a construction and arrangement is disclosed in U.S. patent application Ser. No. 10/951,149 filed on Sep. 27, 2004 and Ser. No. 11/059,038 filed on Feb. 16, 2005, the disclosures of which are incorporated herein by reference in their entirety. Both of these patent applications are now abandoned in favor of U.S. patent application Ser. No. 11/285,554, filed on Nov. 21, 2005 and now U.S. Pat. No. 7,275,508 and U.S. patent application Ser. No. 11/414,423, filed on Apr. 26, 2006 and now U.S. Pat. No. 7,334,551.

Accordingly, upon pulling of the starter cord, the choke valve 14 is rotated from its open position toward its closed position. During that rotation, as shown in FIGS. 3-5, the first cam 56 engages and displaces the throttle control member 32. Continued rotation of the choke valve 14 to its closed position will move the first cam 56 out of engagement and past the throttle control member 32, as best shown in FIG. 5. Under the force of its return spring 26, the throttle valve 12 will tend to rotate or slip back toward its idle position until the throttle control member 32 engages the peripheral surface 64 of the choke control member 52. Thereafter, when the force moving the choke valve 14 to its closed position is terminated, the choke valve 14 will tend to rotate back toward its open position under the force of its return spring 72. This will cause the finger 36 of the throttle control member 32 to be received within the first catch 60 of the choke control member 52 and provide an interference between the control members 32, 52 that prevents their continued rotation. This holds the choke valve 14 and the throttle valve 12 in their respective start positions. Accordingly, the throttle valve 12 is moved from its idle position and held in a start position that is between its idle and wide open positions. In an exemplary embodiment, the choke valve 14 is permitted to rotate slightly away from its fully closed position and is held in its start position permitting a desired air flow therethrough to provide an enriched fuel and air mixture from the carburetor 10 to facilitate starting and warming up a cold engine.

With the valves 12, 14 in their start positions, a richer than normal fuel and air mixture is provided until the throttle valve 12 is actuated toward its wide open position sufficiently to remove the throttle control member 32 from the first catch 60. Preferably, a stop surface 80 (FIG. 4) of the first catch 60 is generally tangential to the rotational path of the finger 36 of the throttle control member 32 to permit the finger 36 to relatively easily be removed or withdrawn from the first catch 60 as the throttle valve 12 is rotated toward its wide open position. Upon removal of the finger 36 from the catch 60, the choke valve 14 rotates back to its open position under the force of its return spring 72. Thereafter, the throttle valve 12 can rotate freely between its idle and wide open throttle positions without engagement or interference of the throttle control member 32 with the choke control member 52.

As best shown in FIGS. 7-10 (including their A and B counterparts), in the exemplary embodiment shown, the engine may also be started with the throttle valve 12 held in or near its wide open position. FIGS. 7A and 7B illustrate the throttle valve 12 in its wide open position and the choke valve 14 in its open position, prior to pulling the starter cord to start the engine. Upon pulling the starter cord, the choke valve 14 and its control member 52 are rotated toward the closed position of the choke valve 14 until the second cam 58 engages the throttle control member 32, as best shown in FIGS. 8A and 8B. Further rotation of the choke valve 14 towards its closed position passes the second cam 58 over the tab 42 of the throttle control member 32. To facilitate this movement, the second cam 58 may include an inclined surface and the choke control member 52 may be made of a relatively flexible material such as any of various plastics, and the choke valve shaft 44 itself may also be made of a plastic material permitting some flexing of the choke valve shaft 44 as the second cam 58 engages and rides over the tab 42 or other corresponding portion of the throttle control member 32. Some play may also be provided in the choke valve 14, for example, a gap may be provided between the choke valve head 48 in the fuel and air mixing passage 16 permitting limited movement of the head 48 in the passage 16.

Figure 9B:
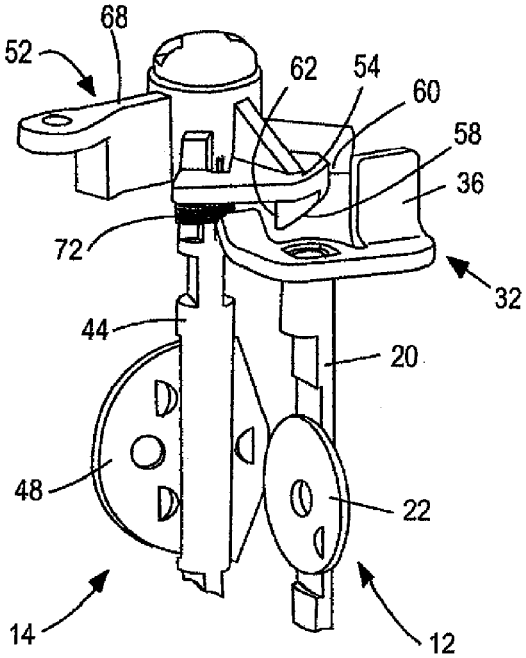
Figure 10B:
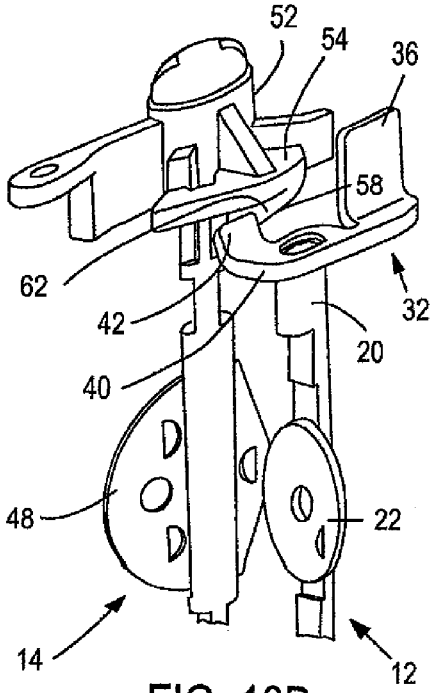

Further rotation of the choke valve 14 will rotate the second cam 58 past the tab 42 of the throttle control member 32 as best shown in FIGS. 9A and 9B. Upon release of the force rotating the choke valve 14 to its closed position, its return spring 72 will rotate the choke valve 14 back toward its open position and thereby move the second catch 62 into engagement with the tab 42 of the throttle control member 32 preventing further rotation of the choke valve 14 toward its open position. This interference between the throttle control member 32 and choke control member 52 will hold the choke control member 52 in a desired position for starting of the engine. That position may be a fully closed position of the choke valve 14 or some position rotated away from its closed position to provide an enriched fuel and air mixture to facilitate starting and warming up the engine. Thereafter, upon release of the throttle valve 12 from its wide open position, it will return toward its idle position under force of its return spring 26. This will disengage the tab 42 from the second catch 62 and permit rotation of the choke valve 14 to its open position under force of its return spring 72. Thereafter, the throttle valve 12 may be actuated for normal operation of the engine without interference between the throttle control and the choke control members 32, 52.

Another exemplary embodiment of a carburetor 100 is shown in FIGS. 11-15. In this carburetor 100, the choke valve 102 includes a first control member 104 on one end of its shaft 106 and a second control member 108 on the opposite end of its shaft 106 (FIG. 12B). The throttle valve 110 likewise includes a first control member 112 on one end of its shaft 114 (FIG. 12B) and a second control member 116 on the opposite end of its shaft 114. Hence, the fuel and air mixing passage, and an axis or centerline thereof, extends between the first and second throttle control members and the first and second choke control members. In this implementation, the first choke control member 104 may be constructed substantially as set forth with regard to the previous embodiment choke control member 52 with the exception that it does not include a second cam 58 or second catch 62. Rather, a second cam 58' and second catch 62' are provided on the second choke control member 108 on the opposite end of the choke valve shaft 106. The first throttle control member 112 may include an arm 34' and axially extending finger 36' substantially as set forth with regard to the previous embodiment throttle control member 32. However, the second arm 40' and tab 42' of the first embodiment carburetor 10 that cooperated with the choke control member 52 during starting of an engine with the throttle valve 12 in its wide open position, are disposed on the second throttle control member 116. Accordingly, when the engine is started with the throttle valve 110 in its idle position, a first cam 56' of the first choke control member 104 engages the finger 36' of the first throttle control member 112 in the same manner as previously described for the carburetor 10. And the first finger 36' is received in a first catch 60' to position the throttle valve 110 and choke valve 102 in their start positions in the same manner as previously described. Accordingly, starting the engine with this embodiment carburetor 100 having its throttle valve 110 in its idle position will not be further described.

Figure 11:
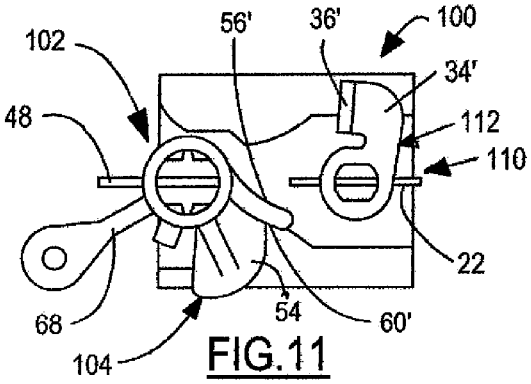
FIG. 11 is a front view of a charge forming device having alternate embodiments of the choke control member and throttle control member both shown in their open position.
Figure 12A:
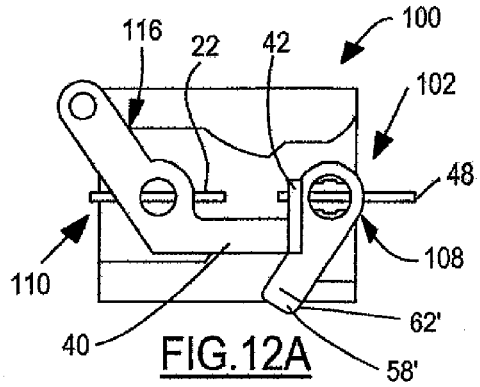
FIG. 12A is a back view of the charge forming device of FIG. 11 illustrating a second choke control member and a second throttle control member with both the choke valve and throttle valve shown in their open position.
Figure 13:
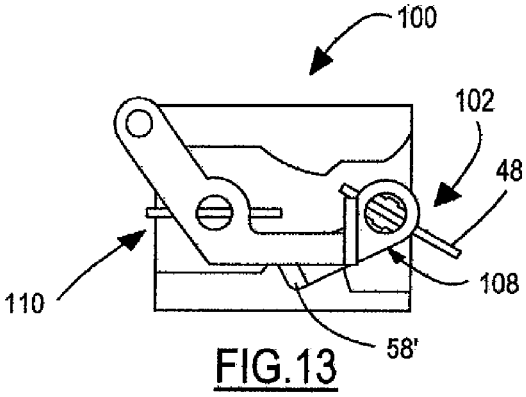
FIGS. 13-15 are back views of the charge forming device like FIG. 12A, and illustrate the second choke and throttle control members in their respective positions as the choke valve is moved to its closed position while the throttle valve is held open.
Figure 14:
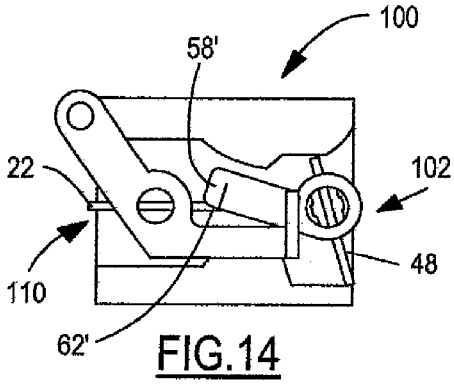
Figure 15:
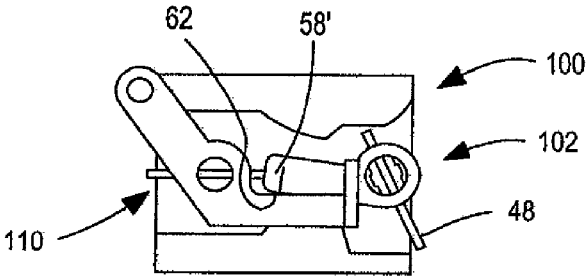
Figure 12B:
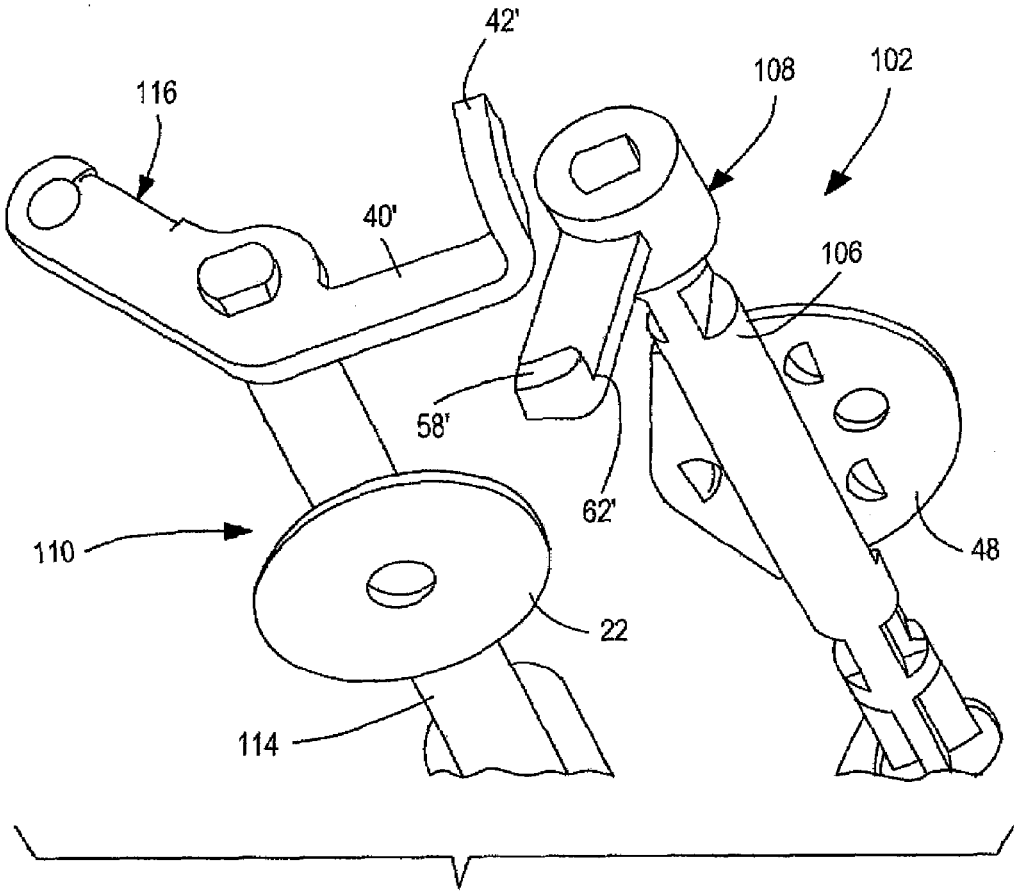
FIG. 12B is a perspective view of the second choke and throttle control members shown in the same position as FIG. 12A.

When the throttle valve 110 is held in its wide open position prior to starting the engine, as shown in FIGS. 11 and 12, the choke valve 102 is initially in its open position. As the choke valve 102 is rotated to its closed position, such as by pulling a starter cord to which the throttle valve is linked or connected, the second cam 58' is rotated into engagement with the arm 40' of the second throttle control member 116. The second cam 58' may include an inclined ramp surface to facilitate passing the second cam 58' beyond the arm 40' of the second throttle control member 116, as shown in FIG. 14. Here, unlike the previous embodiment, the tab 42' is not needed to engage the cam 58'. Upon release of the force rotating the choke valve 102 to its closed position, the choke valve 102 will rotate toward its open position under force of its return spring and the second catch 62' will engage the arm 40' of the throttle control member 116 to maintain the choke valve 102 in a desired position. This is similar to the previous embodiment, but different control members are used in this embodiment. This position may be a fully closed position of the choke valve 102 or some intermediate position between its closed and open positions to provide a desired air flow through the fuel and air mixture passage.

Accordingly, the exemplary embodiments shown and described herein permit starting of an engine with the throttle valve 12, 110 in its idle position, a start position off idle or its wide open throttle position. The choke valve 14, 102 may be manually actuated, or may be actuated automatically upon starting of the engine. This may be accomplished, for example, by linking or connecting the choke valve 14, 102 to a starter mechanism such as a starter cord that is actuated to start the engine. In doing so, the starting procedure is simplified because the user does not have to move the choke valve 14, 102 and pull the starter cord but instead has only to pull the starter cord with the choke being automatically actuated. The carburetor 10, 100 further permits control of the position of the choke valve 14, 102 during starting and initial warming up of the engine by engagement of a choke control member 52, 104, 108 with the throttle control member 32, 112, 116 in plurality of starting positions of the throttle valve 12, 110. Accordingly, a desired magnitude of choke can be provided during starting of the engine in any of the positions of the throttle valve.

The invention claimed is:

1. A charge forming device for an engine, comprising:

a body having a fuel and air mixing passage;

a throttle valve that is movable between a first position and a second wide open throttle position to control at least in part the fluid flow in the fuel and air mixing passage;

a choke valve that is movable between a first open position and second at least partially closed position to control at least in part the fluid flow in the fuel and air mixing passage;

a throttle control member associated with the throttle valve; and a choke control member associated with the choke valve so that when the choke valve is moved from its first position to its second position the choke control member is selectively engaged with the throttle control member in either its first or second positions to hold the choke control member in its second at least partially closed position spaced from its first position to provide an enriched fuel and air mixture to facilitate starting a cold engine.

2. The device of claim 1 wherein the choke valve is closed when it is in its second position, and wherein the choke valve has an intermediate start position between its first and second positions and the start position is defined by engagement of the choke control member with the throttle control member.

3. The device of claim 2 which also includes a biasing member that yieldably biases the choke valve to its first position, and wherein the choke valve is automatically moved from its first position to its second position by actuation of an engine starting system and then the choke valve is returned from its second position toward its first position by the biasing member until the choke control member engages the throttle control member.

4. The device of claim 3 wherein the throttle valve is in its first position when the starting system is actuated.

5. The device of claim 4 wherein the first position of the throttle valve is its idle position.

6. The device of claim 4 wherein the choke control member engages the throttle control member when the choke valve is rotated toward its second position and thereby moves the throttle valve away from its first position and continued engagement of the choke control member and throttle control member maintains the throttle valve in a position spaced from its first position.

7. The device of claim 3 wherein the throttle valve is in its second position when the starting system is actuated.

8. The device of claim 6 wherein when the throttle valve is in its second position it is wide open.

9. The device of claim 8 wherein the throttle control member includes a first portion adapted to engage the choke control member when the throttle valve is in its first position and a second portion adapted to engage the choke control member when the throttle valve is in its second position.

10. The device of claim 1 which also includes an engine starting system, wherein the starting system includes a feature connected to the choke control member to automatically move the choke valve as the engine starting system is actuated.

11. The device of claim 1 wherein the choke control member includes a first cam that engages and displaces the throttle control member from its first position when the choke valve is moved to its second position, and a first catch that engages the throttle control member to releasably hold the positions of the throttle valve and the choke valve.

12. The device of claim 1 wherein the choke control member includes a second cam that engages the throttle control member when the choke valve is rotated to its second position and the throttle control member is in its second position, and a second catch that engages the throttle control member to releasably hold the positions of the throttle valve and the choke valve.

13. The device of claim 1 which also comprises:

the first throttle control member and a second throttle control member both associated with the throttle valve;

the first choke control member and a second choke control member both associated with the choke valve, the first choke control member being engageable with the first throttle control member when the throttle valve is in its first position and the choke valve is in its second position, and the second choke control member being engageable with the second throttle control member when the throttle valve is in its second position and the choke valve is in its second position.

14. The device of claim 13 wherein the throttle valve includes a throttle valve shaft, the first throttle control member is carried on the throttle valve shaft, the second throttle control member is carried on the throttle valve shaft, and an axis of the fuel and air mixing passage extends between the first throttle control member and the second throttle control member.

15. The device of claim 14 wherein the throttle valve shaft extends through the fuel and air mixing passage and the first throttle control member is carried adjacent one end of the throttle valve shaft and the second throttle control member is carried adjacent the opposite end of the throttle valve shaft.

16. The device of claim 13 wherein at least one of the second choke control member and the second throttle control member include a ramped surface adapted to engage and move over a portion of the other of the second choke control member and the second throttle control member to permit the throttle valve and the choke valve to be moved to their second positions.

17. The device of claim 16 wherein the throttle valve includes a throttle valve shaft and the choke valve includes a choke valve shaft and at least one of the throttle valve shaft or the choke valve shaft is constructed and arranged to permit the ramped surface to move over a portion of the other control member.

18. The device of claim 17 wherein the choke valve shaft is formed from a flexible material.

19. The device of claim 16 wherein at least one of the throttle valve and the choke valve is capable of being rotated beyond its second position and relative to the other valve.

20. The device of claim 19 wherein said at least one of the throttle valve and the choke valve is yieldably biased toward its first position and when rotated beyond its second position, the bias tends to rotate the valve back to its second position.

21. The device of claim 13 wherein the first position of the throttle valve is at least one of its idle position or a start position.

22. The device of claim 13 wherein the second position of the throttle valve is at least one of its wide open position or a start position.

23. The device of claim 13 wherein one of the first or second choke control members includes a first cam that engages and displaces a corresponding one of the first and second throttle control members from its first position when the choke valve is moved to its second position, and a first catch that engages the corresponding one of the first and second throttle control members to releasably hold the positions of the throttle valve and the choke valve.

24. The device of claim 13 wherein one of the first or second choke control members includes a second cam that engages a corresponding one of the first and second throttle control members when the choke valve is rotated to its second position and the corresponding one of first and second throttle control members is in its second position, and a second catch that engages the corresponding one of the throttle control members to releasably hold the positions of the throttle valve and the choke valve.

* * * * *